US009475057B2

(12) United States Patent
Williams et al.

(10) Patent No.: US 9,475,057 B2
(45) Date of Patent: Oct. 25, 2016

(54) LINER ELEMENTS WITH IMPROVED WEAR-LIFE FOR GRINDING OPERATIONS

(71) Applicant: Cabot Corporation, Boston, MA (US)

(72) Inventors: William R. Williams, Charlotte, NC (US); Anand Prakash, Wilimington, MA (US)

(73) Assignee: Cabot Corporation, Boston, MA (US)

( * ) Notice: Subject to any disclaimer, the term of this patent is extended or adjusted under 35 U.S.C. 154(b) by 402 days.

(21) Appl. No.: 14/161,763

(22) Filed: Jan. 23, 2014

(65) Prior Publication Data

US 2014/0203129 A1 Jul. 24, 2014

Related U.S. Application Data

(60) Provisional application No. 61/756,154, filed on Jan. 24, 2013.

(51) Int. Cl.
*B02C 17/22* (2006.01)
*B02C 17/18* (2006.01)

(52) U.S. Cl.
CPC ..... *B02C 17/1825* (2013.01); *B02C 17/225* (2013.01)

(58) Field of Classification Search
CPC . B02C 17/18; B02C 17/1825; B02C 17/225; B02C 17/22
USPC ..... 241/183
See application file for complete search history.

(56) References Cited

U.S. PATENT DOCUMENTS 3,335,200 A 8/1967 Thorn
3,403,121 A 9/1968 Hare
4,052,014 A * 10/1977 Jonsson ..... B02C 17/225 241/183
5,516,051 A * 5/1996 Brisbois ..... B02C 17/225 241/172
5,763,388 A 6/1998 Lightsey et al.
(Continued)

FOREIGN PATENT DOCUMENTS

WO WO2006/076763 7/2006
WO WO2006/076764 7/2006
(Continued)

OTHER PUBLICATIONS

Yahyaei et al., Spreadsheet-Based Modeling of Linear Wear Impact on Charge Motion in Tumbling Mills, Mineral Engineering, vol. 23, pp. 1213-1219 (2010).

*Primary Examiner* — Mark Rosenbaum

(57) ABSTRACT

Some of the embodiments described herein relate to liner elements such as lifter bars that can be used in grinding mills. In one example, a lifter bar has a top elastomeric layer and a bottom elastomeric layer, the composition of the top elastomeric layer being different from that of the bottom elastomeric layer. In another example, a lifter bar is constructed from carbon black-reinforced natural rubber and has a leading face and a protrusion at a top region of the leading face. In a further example, a lifter bar is fabricated from carbon black-reinforced natural rubber and has a leading face geometry such that face angle θ remains 25° or less over an operational period measured form the time the lifter bar is new, until the height of the lifter bar is reduced by a certain amount, e.g., by 80%. Also disclosed are methods for manufacturing an elastomeric liner element and for grinding an ore.

15 Claims, 4 Drawing Sheets

(56) References Cited

U.S. PATENT DOCUMENTS

| | | | |
|---|---|---|---|
| 5,832,583 | A | 11/1998 | Wason |
| 6,048,923 | A | 4/2000 | Mabry et al. |
| 6,646,028 | B2 | 11/2003 | Lopez-Serrano Ramos et al. |
| 6,841,606 | B2 | 1/2005 | Yanagisawa |
| 6,929,783 | B2 | 8/2005 | Chung et al. |
| 7,101,922 | B2 | 9/2006 | Chen et al. |
| 7,887,000 | B2 | 2/2011 | Siitonen |
| 7,997,517 | B2 | 8/2011 | Melo et al. |
| 8,016,220 | B2 | 9/2011 | Melo et al. |
| 8,152,086 | B2 | 4/2012 | Moller et al. |
| 8,622,330 | B2 * | 1/2014 | Mepham ..... B02C 17/225 241/182 |
| 2010/0233420 | A1 | 9/2010 | Ghosh et al. |
| 2012/0228416 | A1 | 9/2012 | Page et al. |

FOREIGN PATENT DOCUMENTS

| | | |
|---|---|---|
| WO | WO2007/048874 | 5/2007 |
| WO | WO2009/008810 | 1/2009 |
| WO | WO2009/050723 | 4/2009 |
| WO | WO2009/099623 | 8/2009 |

* cited by examiner

LINER ELEMENTS WITH IMPROVED WEAR-LIFE FOR GRINDING OPERATIONS

CROSS REFERENCE TO RELATED APPLICATIONS

This patent application claims the benefit of U.S. Provisional Patent Application No. 61/756,154, filed on Jan. 24, 2013, the entire contents of which are incorporated herein by reference.

BACKGROUND OF THE INVENTION

Many grinding operations are conducted in rotating/tumbling mills, generally in the form of hollow cylindrical drums. In a grinding mill operation, ore is introduced at a feed or charge end and comminuted (reduced in size) ore exits the mill at a discharge end. Typically, the mill is rotated about a horizontal axis or at a slight angle to the horizontal. During rotation, the material within the mill is lifted or carried up the ascending side of the shell and is tumbled back down to impact the "toe" of the charge (bottom of the mill). The fall of ore and/or its collision with grinding aids, if used, crushes the ore to a smaller size. This comminution process can involve various mechanisms including abrasion, attrition, impact forces, and so forth.

Ore grinding can be classified as autogenous grinding (AG), semi-autogenous (SAG), or media enhanced. AG processes do not use grinding aids (media). Rather, the material (ore) itself performs the crushing. SAG mills employ relatively small amounts of grinding media, such as, for instance, steel balls of five inches in diameter. A typical SAG mill uses a grinding media charge of about 8 to 20 percent (%) of the total volume of the mill. In contrast, media enhanced grinding uses a large percentage (typically about 30%) of smaller grinding aids, such as pebbles, balls (ball mills) or rods (rod mills).

In mining applications, grinding mills can also be classified as primary or secondary types, with primary mills receiving heavy mineral, typically ten inches in size or more and producing crushed material of, for example, about ¼ inch in size. Secondary mills receive the smaller ore material and further grind it, e.g., to a powder. Minerals may then be extracted from the powder by chemical or flotation techniques or by other methods, as known in the art. AG and SAG mills are commonly used in the primary stage, while ball or rod mills are used in the secondary stage.

The interior of a grinding mill such as, for instance, an AG or SAG mill, is provided with steel or rubber liners disposed longitudinally (parallel to the cylinder axis) and fitted with lifter bars. Due to the large size and weight of the liners, they are often formed from liner components (elements or segments) that can be individually secured to the drum or shell of the mill, e.g., by bolts or other suitable attachments. Liners and/or elements thereof (e.g., lifter bars) perform various functions, including those of protecting and insulating the shell, sealing the shell against corrosive charge, lifting and releasing portions of the charge, and so forth. Typical arrangements of liners and liner components are described, for example, in U.S. Pat. No. 5,832,583 issued on Nov. 10, 1998 to Wason and U.S. Application Publication No. 2012/0228416 A1 to Page et al., published on Sep. 13, 2012, both documents being incorporated herein by reference in their entirety.

Traditionally, when rubber (elastomeric) liner elements such as lifters (also referred to herein as lifter bars) are utilized, the type of rubber employed is a blend of natural rubber (NR) and butadiene rubber (BR), reinforced with carbon black (CB). Generally, blends of NR-BR can contain the two polymers in various ratios, depending on the application. In a typical liner element such as a lifter bar, the ratio BR:NR is about 40:60.

Over time, exposure to the abrasion and impact forces generated during grinding leads to the wear of the liners and/or elements thereof, as described, for instance, in U.S. Pat. No. 5,832,583. Wear patterns were investigated by M. Yahyaei and S. Banisi in the article *Spreadsheet-Based Modeling of Liner Wear Impact on Charge Motion in Tumbling Mills*, Mineral Engineering Vol. 23, pp. 1213-1219 (2010). The results presented in the latter document indicated, for instance, that after 4,000 hours of operation, the lifter face angle could increase from 14° to 47.1° and the height of lifters decrease from 15.2 to 5.8 cm. In addition, the article reported a non-uniform wear profile along the length of the mill.

Eventually a point is reached when worn liners or elements thereof must be replaced. In primary grinding, for example, lifters are usually removed from the mill when the lifting effect of the lifting bars is reduced through wear to approximately two to two and one-half inches in height. In many instances, the useful life of a lifter bar operated under aggressive grinding conditions is about 6 months. With less severe grinding, lifter bars can last up to about 2 years before needing to be replaced.

A variety of configurations of grinding mills and mill components such as liners, wear elements, and lifter bars, have been developed with the goal of improving performance, including increasing performance lifetimes. Examples include US patents, US published applications and PCT Publications Nos. WO2006/076764, U.S. Pat. No. 8,016,220, WO2006/076763, U.S. Pat. No. 7,997,517, WO2009/050723, US2010233420, WO2009/008810, U.S. Pat. No. 8,152,086, WO2007/048874, U.S. Pat. No. 7,887,000, their teachings being incorporated herein by reference.

Nevertheless, the mill needs to be stopped while the linings are replaced. This is time consuming and labor intensive, often requiring special equipment. It is associated with significant costs and impacts the overall productivity of the mill, especially if downtime for replacing wear components is unscheduled.

SUMMARY OF THE INVENTION

A need continues to exist, therefore, for strategies to reduce or minimize the frequency at which liners or elements thereof need to be replaced. For example, a need exists for liners and/or elements thereof that have improved wear life.

In one aspect of the invention, a lifter bar includes a top elastomeric layer and a bottom elastomeric layer, the composition of the top elastomeric layer being different from that of the bottom elastomeric layer. In some implementations, the upper layer has better properties than the bottom layer with respect to at least two of tensile strength, tear strength and cut/chip resistance. In other implementations, the bottom layer has better DIN abrasion resistance than the top layer. The top layer can be made of CB-reinforced NR and the bottom layer of a CB-reinforced blend of NR-BR. In further implementations, elastomers employed in the top elastomeric layer and/or in the bottom elastomeric layer are produced by wet masterbatch methods.

In another aspect of the invention, a method for manufacturing an elastomeric liner element comprises: determining an expected wear profile of the elastomeric liner element; and joining together a bottom elastomeric layer and a top elastomeric layer, the top elastomeric layer having a different composition from the bottom elastomeric layer, wherein the interface of the two layers follows the expected wear profile.

In a further aspect of the invention, a lifter bar is constructed from CB-reinforced NR and has a leading face and a protrusion at a top region of the leading face. In specific embodiments, only the leading face has a protrusion at its top. In some cases, the lifter bar also has a trailing face; the trailing face and the leading face are not symmetrical with reference to a surface normal to the face of the lifter bar and intersecting the lifter bar between the leading face and the trailing face.

In yet another aspect of the invention, a lifter bar is fabricated from CB-reinforced NR and has a leading face geometry such that face angle θ remains 25° or less over an operational period measured form the time the lifter bar is new until the height of the lifter bar is reduced, e.g., by 80%.

The invention also relates to a method for grinding an ore. The method comprises: rotating a lifter bar disposed at an interior wall of a rotating mill; lifting a portion of the ore in the mill on the lifter bar, as the lifter bar ascends; and raising the lifter bar higher causing the portion of the ore to tumble, due to gravity. In one embodiment, the lifter bar includes a top elastomeric layer and a bottom elastomeric layer, the composition of the top elastomeric layer being different from that of the bottom elastomeric layer. In another embodiment, the lifter bar is made of CB-reinforced NR and has a protrusion at a top region of a leading face. In a further embodiment, the lifter bar is fabricated from CB-reinforced NR and has a leading face geometry such that face angle θ remains 25° or less over an operational period measured form the time the lifter bar is new, until the height of the lifter bar is reduced by 80%.

Aspects of the invention provide improved wear and decrease or minimize the frequency with which liners and/or elements thereof must be replaced. Practicing embodiments described herein can reduce mill down time and maintenance costs, while increasing mill efficiency and production.

The above and other features of the invention including various details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention generally relates to grinding operations and mills. In specific embodiments, the invention pertains to liners and/or liner elements used in AG or SAG mills and in particular to elastomeric lifter bars. In other embodiments the liners and/or liner elements (components) described herein can be utilized or adapted to other types of grinding mills.

Figure 1:
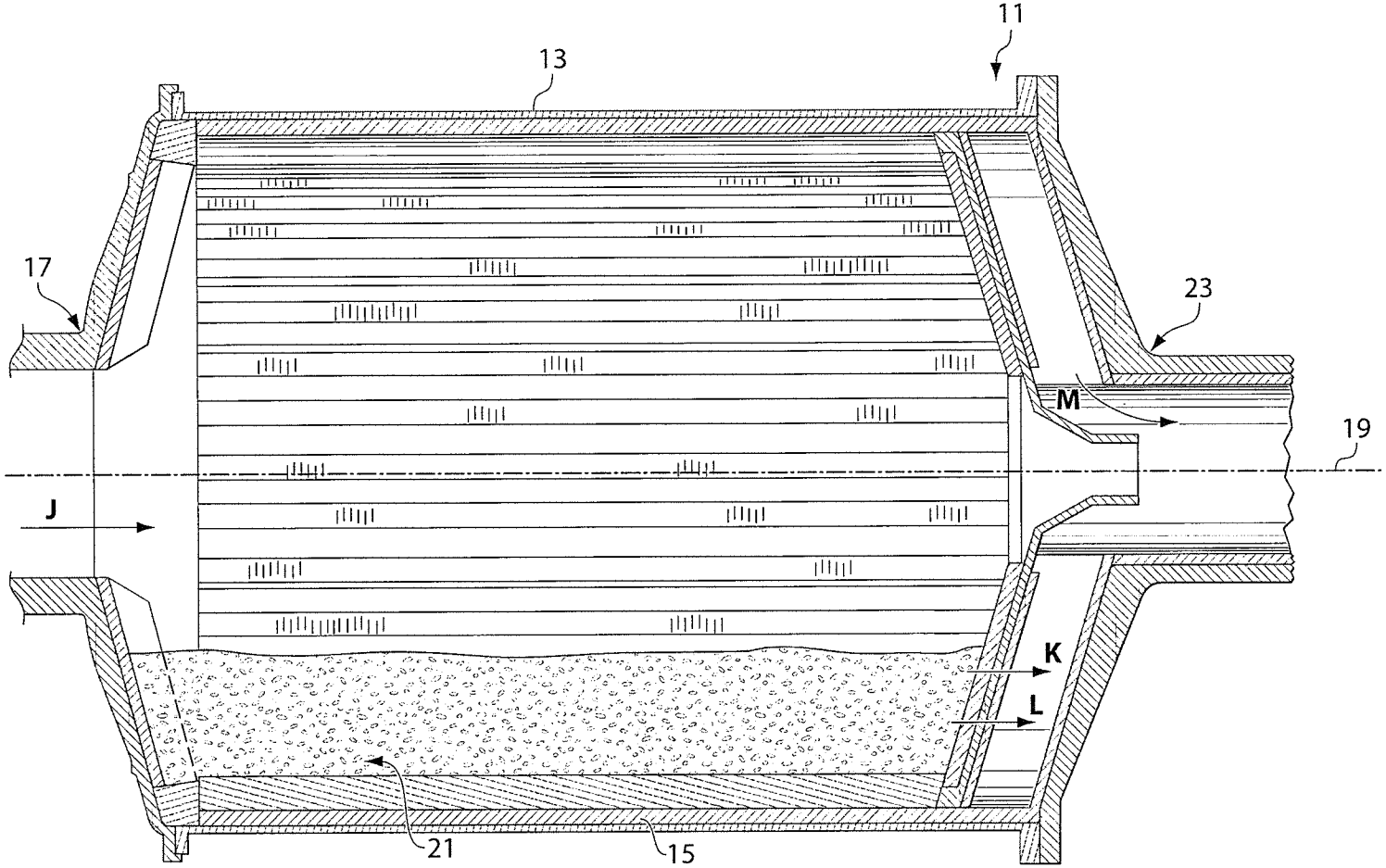
FIG. 1 is a longitudinal cross-section of a grinding mill such as, for example, an AG or SAG mill.

Shown in FIG. 1, for example, is a longitudinal cross-section of mill 11 suitable for AG or SAG ore comminution. Mill 11 includes shell 13, typically cylindrical in shape fitted with lifter bars 15. Ore and optional grinding media are introduced into the mill in the direction of arrow J through feed (or charge) end 17. As mill 11 rotates around axis 19, charge 21 tumbles, reducing the size of the ore. Comminuted ore exits the mill in the direction of arrows L, K and M at discharge end 23.

Mill dimensions and operational parameters can vary. For instance, a SAG mill such as the one studied by M. Yahyaei and S. Banisi in the article Spreadsheet-Based Modeling of Liner Wear Impact on Charge Motion in Tumbling Mills, Mineral Engineering Vol. 23, pp. 1213-1219 (2010) is operated by two 5500 hp synchronous motors, at a constant 10.5 rpm rotational speed in two directions, and is lined with two series of 60-row liners.

Figure 2:
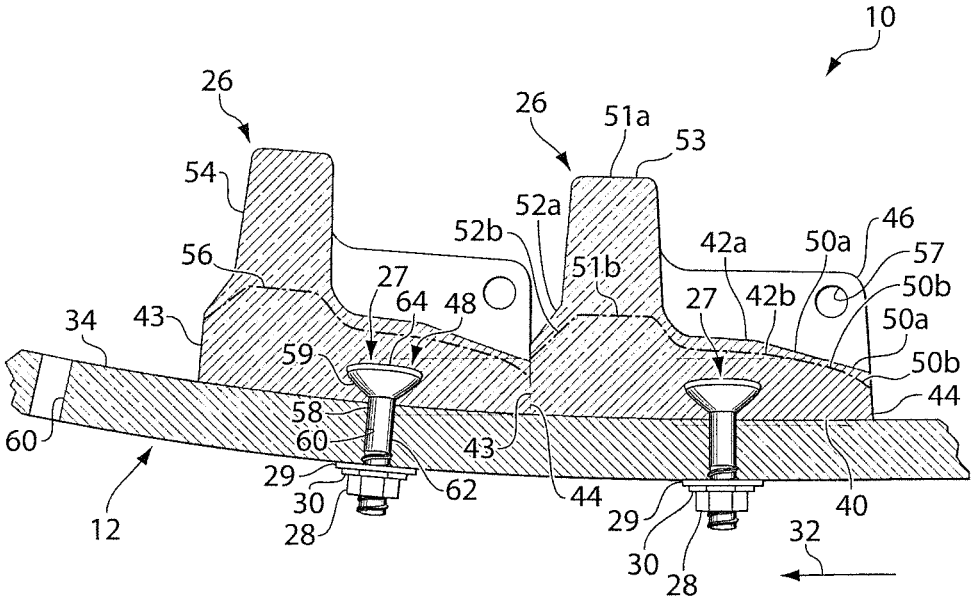
PRIOR ART Fig. 2
FIG. 2 is a sectional view of a portion of the mill of FIG. 1, showing a liner in greater detail.

FIG. 2 is an enlarged fragmentary sectional view of a conventional arrangement (as described in U.S. Pat. No. 5,832,583) that can be utilized in the lining of a mill such as mill 10. As shown by FIG. 2, liner elements 26 are mounted adjacent to one another along an inner diameter 34 of shell 12 so as to provide a continuous seal or lining along the inner diameter 34 of shell 12. Each liner element 26 includes a bottom surface or back face 40, a top or working face 42*a*, front edge 43, rear edge 44, lifting lug 46 and slot 48. Back face 40 is generally opposite working face 42*a* and has a contoured shape or curve for mating with inner diameter 34 of shell 12. The contour of back face 40 can be convex, while inner diameter 34 of shell 12 is concave. When the contour of back face 40 mates with inner diameter 34 of shell 12, gaps between shell 12 and liner element 26 can be sealed and eliminated. This prevents contact between the shell and possibly corrosive material fed to the mill.

The top face or working face 42*a* of liner element 26 extends upwardly away from back face 40 and includes trailing surface 50*a*, lifting surface 51*a* and leading surface 52*a*. Trailing surface 50*a* longitudinally extends along a rearwardmost side of liner element 26 and slants slightly upward away from back face 40. In specific examples, trailing surface 50*a* can have a thickness of about three inches at edge 44 and a thickness of about four inches near lifting surface 51*a*.

Working face 42*a* extends vertically upward away from trailing surface 50*a* and back face 40 to form lifting surface 51*a*. Lifting surface 51*a* preferably projects upwardly from back face 40 above trailing surface 50*a* to produce a lifting effect suitable for AG and SAG mills. Lifting surface 51*a* can have a height of about nine inches above trailing surface 50*a* and includes top surface 53 and lifting area 54 which lifts and carries material up an ascending side of shell 12 so that the material tumbles down over itself to grind or pulverize itself.

Leading surface 52*a* longitudinally extends between edge 43 and lifting surface 51*a* opposite trailing surface 50*a*. Leading surface 52*a* has a contour which slopes upward from front edge 43 to lifting surface 51*a*. Leading surface 52*a* lines or covers and protects shell 12.

Leading surface 52*a* slopes upward from front edge 43 to lifting area 54 of lifting surface 51*a*. Leading surface 52*a* preferably has a thickness of about four inches at edge 43 and a thickness of about five inches at lifting surface 51*a*. As a result, lifting surface 51*a* extends above leading surface 52*a* by about eight inches and above edge 44 by about nine inches.

Leading surface 52*a* extends upward at an angle with respect to the vertical. In a new liner, the angle is larger than 0° and, typically, less than about 35°.

Liner element 26 can be provided with lifting lug 46 having a large aperture 57 which permits liners 26 to be lifted into place. Slot 48 has a V-shaped slot or groove longitudinally extending along and through liner 26. Slot 48 can be centered between edges 43, 44 along the entire longitudinal length of liner 26. It includes channel 58 for receiving shank 62 of V-shaped bolts 27. As seen in the drawing, shell 12 is provided with mounting holes 60.

With continued use, liner elements 26 wear out. As described in U.S. Pat. No. 5,832,583, dashed line 56 illustrates a working face 42*b* of a worn liner element having trailing surface 50*b*, lifting surface 51*b* and leading surface 52*b*. Trailing surface 50*b*, lifting surface 51*b* and leading surface 52*b* extend generally parallel to the original working face 42*a*, except that lifting surface 51*b* has a more gradual interface with trailing surface 50*b* and initially extends above trailing surface 50*b* by about two to about two and one-half inches.

Figure 3A:
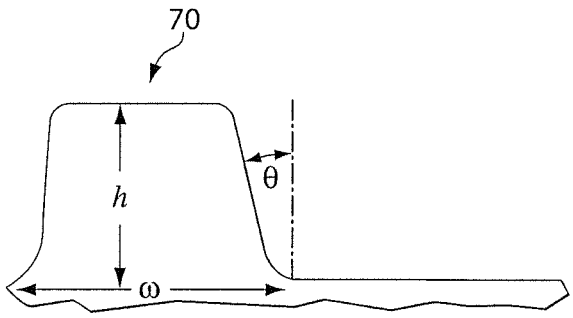
FIG. 3A is a cross sectional profile of a new lifter bar.
Figure 3B:
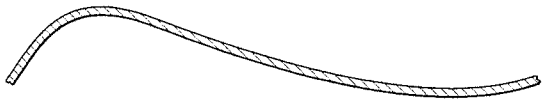
FIG. 3B is a cross sectional profile of the lifter of FIG. 3A worn by use.

A more detailed wear pattern analysis focused on lifters (lifter bars) is provided by M. Yahyaei and S. Banisi in the article *Spreadsheet-Based Modeling of Liner Wear Impact on Charge Motion in Tumbling Mills*, Mineral Engineering Vol. 23, pp. 1213-1219 (2010). Shown in FIG. 4 of this publication, for example, is the change in a lifter profile in its new state (diamonds), through 3297 hours of use (squares), and 5384 hours of use (triangles). The wear patterns revealed by the model used by M. Yahyaei and S. Banisi show that both the height and lifter face angle change with wear. Based on this model, a cross sectional view of a new liner element, e.g., lifting bar 70, having lifter height h, lifter width w and face angle θ is shown in FIG. 3A. With wear, the liner element has the profile shown in FIG. 3B. As seen in these drawings, not only does the height h of the lifter bar diminish with wear but angle θ opens considerably. As a result of this wear pattern, the lifter bar becomes too small to pick up the relatively large ore pieces fed to a primary mill. In addition, any material that is lifted at all can easily slide off, tumbling prematurely, due to the increased face angle.

By analyzing the wear patterns of a liner element such as a lifter bar we determined that with a new lifter ore impacts the lifter face at almost normal incidence angle. With wear, the angle changes and ore tends to slide past the face of the lifter bar. We also determined that properties that prevent or reduce impact wear, such as tensile strength, tear strength, cut and chip resistance are the more important parameters to consider in a new lifter bar (to withstand impact forces) and that these parameters become less significant as the lifter bar begins to show signs of wear; with use, it is the lifter's resistance to frictional abrasion (caused, for example, by ore and optional grinding aids sliding off the lifter, that becomes increasingly important to the durability and life expectancy of the lifter bar.

One aspect of the invention relates to a liner element, e.g., a lifter bar, having a layered arrangement. In one implementation, a lifter bar has a top elastomeric layer and a bottom elastomeric layer, the two layers having different compositions. Generally, the top elastomeric layer has properties addressing the impact mechanism by which the ore wears the new article. Thus properties of predominant interest in the top layer are good tensile strength, good tear strength and/or reduced cut/chip weight loss. In one example, the top layer has better properties than the bottom layer with respect to at least two of tensile strength, tear strength and cut/chip resistance. In the bottom elastomeric layer (which will eventually become exposed as the top layer is worn away and angle θ increases) the predominant property of interest is good resistance to frictional abrasion.

These properties can be determined and compared as known in the art, using, for example, established techniques, equipment and/or industry standards. Tensile strength can be measured according to ASTM D-412 and tear strength according to ASTM-D624 using Die C. Cut/chip properties can be measured on apparatus known to those of skill in the art, including TechPro Cut and Chip tester, available from Alpha Technologies, Akron Ohio or BF Goodrich Cut and Chip tester, from Corporate Consulting, Service & Instruments, Inc., Akron, Ohio. Frictional abrasion of elastomeric materials can be determined following an industry standard such as DIN 53516 (Testing of Rubber and Elastomers; Determination of Abrasion Resistance), ASTM D5963 or ISO 4649, using a commercial DIN type abrader tester. Shore A hardness may be measured as specified in ASTM standard D1415.

Figure 4:
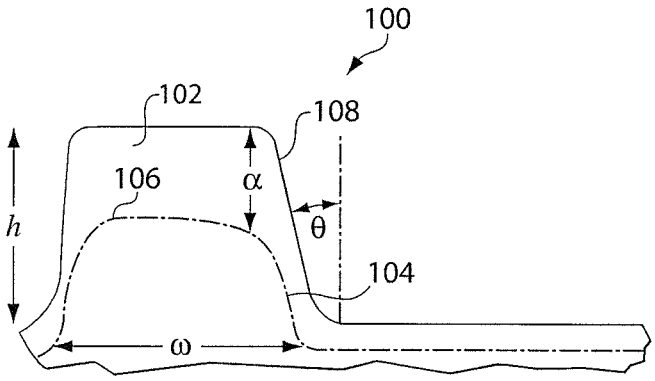
FIG. 4 is a sectional view of a lifter bar (before use) according to embodiments of the invention.

FIG. 4 is a cross sectional view of one embodiment of a lifter bar having two elastomeric layers. Shown in this drawing is lifter bar 100 having top elastomeric layer 102 and bottom elastomeric layer 104. In this embodiment, the contour of the bottom layer (also the interface 106 between the top and bottom layer), follows the expected wear profile of the lifter bar. The expected wear profile can be determined experimentally, by observing the wear of similar lifter bars in the mill, by simulated laboratory techniques, modeling (as seen in the M. Yahyaei and S. Banisi article discussed above), or by other suitable methods.

The thickness of the layers can be determined experimentally or by modeling. In specific embodiments, the top layer is thick enough to last through the initial stages of mill operation, when wear is predominantly caused by impact forces and thin enough so that it is consumed by the time the wear mechanism changes to one predominantly caused by frictional forces (e.g., as ore slides off the lifter bar with increased ease). The balance of the overall height of the lifter bar can be provided by the bottom layer.

In some implementations, the thickness of the top layer is within the range of from about ¼ to about ¾ of the height of the lifter bar. In a design such as that in FIG. 4, for example, thickness a of top layer 102 could be within range from about 4 cm to about 12 cm for an approximately 16 cm high lifter bar.

In many cases, the top layer can be parallel or substantially parallel to the expected wear profile. Other arrangements can be used depending, for example, on costs and/or ease of fabrication, confidence in modeling or laboratory simulations, desire to providing additional refinements in wear protection, and so forth. For example, the profile of the top layer can be simplified to smooth out some of the details in the expected wear profile of the liner element. In other cases, a top layer can be thicker at areas that encounter more severe impact wear and thinner at points that are less likely to be impacted by the ore. The top layer can be provided with bulges or protrusions. For example, the top layer can have a protrusion (not shown in FIG. 4) at the top of leading face 108. Such a design (further described below) can help maintain the angle θ at or close to its initial value during at least part of the useful life of the lifter bar.

In specific implementations, the top layer has a tensile strength that is at least 26 MPa, e.g., within the range of from about 26 to about 34 MPa; or from about 27 to about 32 MPa, such as from about 29 to about 30 MPa; a Die C tear strength that is at least 120 kN/m, e.g., within the range of from about 120 to about 170 kN/m, e.g., from about 135 to about 155 kN/m, such as from about 140 to about 150 kN/m; and/or a cut/chip % weight loss no greater than about 8.5, e.g., within the range of from about 7.0 to about 8.5, such as from about 7.5 to about 8.0.

Frictional abrasion properties of the top layer are less important and the top layer can have a DIN abrasion resistance within the range of from about 80 to about 120 $mm^3$, e.g., from about 90 to about 110 $mm^3$, such as from about 95 to about 105 $mm^3$.

In contrast, the bottom layer has a frictional abrasion resistance, as measured by DIN apparatus, that is better than that of the top layer. Typically the bottom layer has an abrasion resistance measured by DIN that is less than about 80 $mm^3$, e.g., within the range of from about 30 to about 75 $mm^3$, such as from about 40 to about 60 $mm^3$.

On the other hand, properties such as tensile strength, tear strength and/or cut/chip are of lesser concerns for the bottom layer, which can have a tensile strength below 26 MPa, e.g., within the range of from about 18 to less than or equal to about 25 MPa, e.g., from about 20 to about 23 MPa, such as about 22 MPa; a Die C tear strength that is less than 120 kN/m, e.g., within the range of from about 65 to about 115 kN/m; from about 70 to about 110 kN/m; from about 75 kN/m to about 100 kN/m; or from about 80 to about 90 kN/m; and/or a cut/chip % weight loss that is higher than that characterizing the upper layer, e.g., higher than 8.5, such as within the range of from about 8.8 to about 9.5 or higher.

Other properties can be specified for the top and/or bottom layer, as known in the art. For instance, an illustrative lifter bar can include an elastomeric top layer and an elastomeric bottom layer having the characteristics shown in the table below:

| | Top Layer | Bottom Layer |
|---|---|---|
| Tensile Strength (MPa) | 31 | 25 |
| M300/M100 | 6.5 | 5.9 |
| Tear Strength - Die C, kN/m | 149 | 100 |
| Rebound (%) | 49 | 52 |
| Cut/Chip (% wt loss) | 8 | 9.1 |
| DIN abrasion ($mm^3$) | 83 | 41 |
| Hardness (ShA) | 64 | 63 |
| Elongation at break (%) | 515 | 465 |

In one embodiment, the top elastomeric layer is based on NR (e.g., CB-reinforced NR) and the bottom layer is based on a BR-NR blend (e.g., a CB-reinforced 60:40 NR:BR blend). Other suitable NR:BR ratios that can be used for the bottom layer are within the range of from about 90:10 to about 50:50, e.g., from about 80:20 to about 60:40, such as, for instance, 70:30 by weight.

The CB-reinforced elastomers used in the top and/or bottom layer can be produced by any suitable techniques.

Dry mixing, for instance, refers to a solid-state mixing process in which inorganic filler particles such as CB particles are added to elastomers to provide reinforcement and strength. The process can be conducted batch-wise or continuously and is in widespread commercial use. One goal in the mixing operation is that of breaking down the CB raw material to its smallest size (aggregate) in order to distribute and disperse the aggregates uniformly throughout the elastomer; another is to incorporate curing agents and other additives. Typically, dispersion of CB (or other fillers) requires significant mixing energy in order to overcome Van der Waals forces between filler particles. This energy input can cause elastomer degradation via molecular weight reductions, particularly in the case of natural rubbers. Thus, the dry mix compounding process must achieve a balance between optimizing dispersion (breaking down agglomerates of CB to maximize CB-polymer interaction) and optimizing the elastic properties of the polymer (minimizing molecular weight degradation). In practice, there are instances in which optimal dispersion of carbon black filler is difficult or even not possible with conventional dry mixing processes.

In specific embodiments of the invention, elastomers employed in the top elastomeric layer 102, and/or in the bottom elastomeric layer 104, are produced by wet masterbatch methods, in which a natural rubber latex and a carbon black slurry are combined, and the natural rubber latex is caused to coagulate to form a masterbatch crumb.

In some implementations of wet masterbatch methods, the natural rubber latex and carbon black slurry are combined in a continuous flow process at turbulence levels and flow control conditions sufficient to achieve coagulation and formation of masterbatch crumb even without use of traditional coagulating agents. Preferred methods are described in U.S. Pat. Nos. 6,048,923 and 6,929783 and PCT Publication No. WO2009/099623, the contents of which are incorporated herein by reference. Other suitable methods of forming a masterbatch crumb include those disclosed in U.S. Pat. Nos. 5,763,388, 6,048,923, 6,841,606, 6,646,028, 7,101,922, 3,335,200, and 3,403,121, and other wet masterbatch processes known to those of skill in the art. The masterbatch crumb is then dewatered and dried to form an elastomer composite.

Exemplary natural rubber lattices include but are not limited to field latex, latex concentrate (produced, for example, by evaporation, centrifugation or creaming), skim latex (e.g., the supernatant remaining after production of latex concentrate by centrifugation) and blends of any two or more of these in any proportion. The latex should be appropriate for the wet masterbatch process selected and the intended purpose or application of the final rubber product. The latex is provided typically in an aqueous carrier liquid. Selection of a suitable latex or blend of lattices will be well within the ability of those skilled in the art given the benefit of the present disclosure and the knowledge of selection criteria generally well recognized in the industry.

Exemplary carbon blacks may be selected to optimize the desired properties of the top elastomeric layer 102 and bottom layer 104. One of skill in the art will be able to select the appropriate carbon black. Appropriate carbon blacks may be selected from the ASTM N100 series-N900 series carbon blacks, preferably reinforcing grades from the N100 and N200 series. Appropriate carbon blacks may also be selected from those sold under the Regal®, Black Pearls®, Spheron®, Sterling®, and Vulcan® trademarks available from Cabot Corporation, the Raven®, Statex®, Furnex®, and Neotex® trademarks and the CD and HV lines available from Columbian Chemicals, and the Corax®, Durax®, Ecorax®, and Purex® trademarks and the CK line available from Evonik (Degussa) Industries. Preferably such carbon blacks are reinforcing carbon blacks having a BET surface area greater than 100 m2/g. Additional appropriate carbon blacks will also be known to those of skill in the art.

In specific examples wet masterbatch methods are employed to produce the elastomeric top layer 102, e.g., CB-based NR, as well as the elastomeric bottom layer 104, or component thereof, e.g., a CB-based NR in an NR-BR blend. Wet masterbatch techniques also can be utilized to make the elastomer(s) in only one of the layers, e.g., in top layer 102, while the elastomer(s) in other layer, e.g., bottom layer 104, can be produced by a traditional approach such as, for instance, dry mixing.

A lifter bar having layers such as shown in FIG. 4, can be prepared by determining the expected wear profile of the liner element, and joining together a bottom elastomeric layer and a top elastomeric layer, the two layers having different compositions from one another, wherein the interface between the layers has the pattern of the expected wear profile.

Compression molding and injection molding are the common fabrication processes that can be employed to make elastomeric articles. Extrusion represents the easiest way to obtain a desired external profile before the part is cured, but it often requires optimizing temperatures, flow rates, shear, and other parameters of the polymers to maintain the internal profile (the shape of the interface).

A suitable mold can be used to shape the lifter bar. For instance, a precursor elastomeric bottom layer can be placed at the bottom of the mold and a precursor elastomeric top layer can be overlaid onto the bottom layer. The layers can be pressed and cured together, for instance by matching cure rates, to form a composite lifter bar such as shown in FIG. 4.

In a specific example, compression molding is performed layer by layer. The initial (bottom) layer is disposed in the mold at a temperature below the vulcanization temperature. The second layer is added after which the mold is raised to the vulcanization temperature.

Layers 102 and 104 also can be joined together using bonding agents, as known to those of skill in the art or by reactive compatibilization (sometimes referred to as "stitching"). The latter approach relies on reactive compatibilizers such as maleic anhydride to create cross-links between the two layers. Typically, to react with the compatibilizer, the polymers in the two layers have to be end-functionalized. However, natural rubber is not typically end-functionalized.

A lifter bar including two elastomeric layers with different compositions and properties also can be prepared by molding the bottom layer and creating the profile of interface 106 at the top of the of the bottom layer. The bottom layer can then be moved to a second mold, the elastomer used to make the top layer being injected into the profile of interface 106. The two elastomeric layers are linked together mechanically or by other suitable techniques that can be used to bond or glue the layers together.

In many cases, using a lifter bar having only two layers is sufficient to address the different wear mechanisms described above. However, liners or liner elements (e.g., lifter bars) according to this aspect of the invention can have more than two layers. In a three layer arrangement, for instance, the top layer is predominantly resistant to impact forces; the bottom layer has predominantly good resistance to frictional abrasion (e.g., caused by sliding ore and optional grinding media). Sandwiched between the two is an intermediate layer with properties selected to balance the two concerns. Interfaces between these layers can be devised using expected wear profile or other criteria, e.g., as described above, and liner elements including more than two layers can be manufactured using, for example, fabrication techniques already discussed.

By addressing the predominant wear mechanism at various points in the work life of a liner or liner element, e.g., a lifter bar, the durability of the exposed surface is enhanced, resulting in an extended useful life of the article.

Another aspect of the invention relates to designs that allow face angle θ to remain small even with partial or complete wear of the lifter bar, for instance, over the entire useful life of the article (i.e., from new to the time the lifter bar is replaced, as determined or estimated, for example, by a specified reduction in the height of the lifter bar). In one example, angle θ remains 25 degrees (°) or less over the useful life time of the article, for instance, until the height of a new lifter bar has been reduced through wear by 50, 60, 65, 70, 75, 80 or 85%. In other cases, the angle θ does not change at all during this period (i.e., from new, until the height of the lifter bar is worn away by 50, 60, 65, 70, 75, 80 or 85%. To illustrate, a new lifter bar having an initial angle θ of 22° will retain this same angle of 22° at least until the initial height of the bar has been reduced (through wear) by 50, 60, 65, 70, 75, 80 or 85%.

In specific embodiments, a lifter bar has a geometry such that, even with wear, the impact of the ore remains mostly normal to the lifter face. With such a design, the nature of the abrasion remains mostly impact-based throughout most and often throughout the entire useful life of the article. Accordingly, a suitable material used to fabricate the entire lifter bar has good tensile strength, good tear strength and good resistance to cut and chip. Since angle θ does not change much or at all during the lifetime of the lifter bar, resistance to frictional abrasion is less critical.

In one implementation, the material used to fabricate the entire lifter bar has the properties associated with the top layer described above, for instance layer 102 in FIG. 4. In specific examples, the material is CB-reinforced NR. In other specific examples, the material used to fabricate the entire lifter bar is prepared by wet masterbatch techniques, such as described above. In further specific examples, the elastomeric material utilized to form the entire lifter bar is CB-reinforced NR prepared by wet masterbatch methods. In yet other examples, no NR-BR blend is utilized to prepare the lifter bar.

Figure 5:
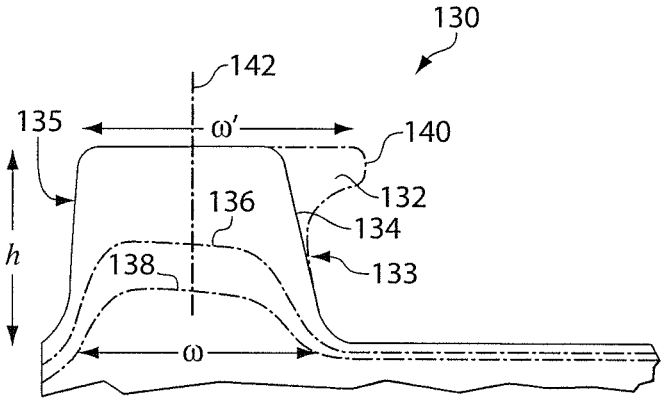
FIG. 5 is a cross sectional view of a lifter bar according to another embodiment of the invention.

FIG. 5 is a cross-sectional view of one embodiment of a lifter bar according to this aspect of the invention. Shown in this drawing is lifter bar 130 (before use) having a protruding portion 132 at the top region of leading face 133. In some implementations, the lifter width w' (measured at the top of lifter bar 130) is at least equal to or exceeds lifter width w. In other implementations, the leading face 133 is concave. In further implementations, only the leading 133 has a protrusion such as protrusion 132. In this case, leading face 133 and trailing face 135 are not symmetrical with respect to surface 142 normal to the face of the lifter bar and intersecting the lifter bar between the leading face and trailing face. In yet other implementations, a second, e.g., symmetrical, protrusion (not shown in FIG. 5) can be present at the trailing face 135.

With usage, it is this protruding portion 132 that wears off and thus the impact of the ore on the lifting face remains almost normal through much or all the useful life of the article. This is further illustrated by profiles (contours) 134, 136 and 138 showing, respectively, a conventionally shaped lifter bar as a new, somewhat worn and completely worn article.

Contour 140 of protrusion 132 can be curved. It can also be defined by multiple (two or more) line segments that can be straight. Contour 140 also can be defined by a combination of curved and straight segments.

The dimensions and/or exact shape of the protruding portion 132 can be determined based on expected wear patterns, expected useful life, ease of manufacture, ore lifting and/or tumbling characteristics desired, and so forth.

If desired, the lifter bar can have a layered arrangement such as described above (see, e.g., FIG. 4), e.g., with a top elastomeric made of CB-reinforced NR and a bottom elastomeric layer made of a CB-reinforced NR-BR blend.

Utilizing a design such as that illustrated in FIG. 5, preferably in combination with a material that has good tensile strength, good tear strength and/or good cut/chip resistance is expected to increase the useful life of the lifter bar.

During grinding, a lifter bar such as described herein is disposed at an interior wall of a rotating mill. In its ascending motion, the lifter bar elevates a portion of the charge present in the mill, e.g., ore and optional grinding aids. As the lifter bar is raised higher, the portion of the charge is caused to tumble, due to gravity.

The present invention, in its various embodiments, can be practiced in any grinding mill that can utilize elastomeric liners or elastomeric liner components (elements), regardless of mill dimensions or operational parameters. Aspects of the invention can be used with new grinding mills or new mill liners or in retrofitting existing equipment. Lifter bars described herein can be spaced around the interior circumference of a mill in any manner suitable to the specific mill and/or intended grinding process.

The invention is further illustrated by the following examples which are not intended to be limiting.

EXEMPLIFICATION

Example 1

A lifter bar is prepared by a layered compression molding process such as described above. A bottom layer of a blend of CB-reinforced NR and BR (ratio NR:BR of 70:30) is placed at the bottom of a mold, at a temperature below the vulcanization temperature. The layer has dimensions and contour of the expected wear profile based on observations of the wear in elastomeric lifter bars made entirely of a blend of CB reinforced NR-BR in a ratio of 70:30. A top layer is placed on top and the mold is brought to the vulcanization temperature.

The resulting lifter bar has a top layer characterized by a tensile strength of 31 MPa; a tear strength, die C of 149 KN/m and a cut/chip % weight loss of 8. Its bottom layer has a tensile strength of 25 MPa; a tear strength, die C of 100 KN/m and a cut/chip % weight loss of 9.1.

Example 2

A lifter bar is fabricated entirely of CB-reinforced NR in a shape such as that shown in FIG. 5 by extrusion. The lifter bar has a tensile strength of 31 MPa; a tear strength, die C of 149 KN/m and a cut/chip % weight loss of 8. The angle θ remains less than 25° over an operational period over which height of the new lifter bar decreases by 80%.

While this invention has been particularly shown and described with references to preferred embodiments thereof, it will be understood by those skilled in the art that various changes in form and details may be made therein without departing from the scope of the invention encompassed by the appended claims.

What is claimed is:

1. A lifter bar comprising a top elastomeric layer constructed from carbon-black reinforced natural rubber and a bottom elastomeric layer, the composition of the top elastomeric layer being different from that of the bottom elastomeric layer, the lifter bar having a leading face and a protrusion at a top region of the leading face.

2. The lifter bar of claim 1, wherein the top layer has better properties than the bottom layer with respect to at least two of: tensile strength, tear strength and cut/chip resistance.

3. The lifter bar of claim 1, wherein the bottom layer has better DIN abrasion resistance that the top layer.

4. The lifter bar of claim 1, wherein the top layer is composed of CB-reinforced NR prepared by wet masterbatch techniques.

5. The lifter bar of claim 1, wherein the bottom layer is based on a blend of NR and BR.

6. The lifter bar of claim 5, wherein the bottom layer is composed of a CB-reinforced blend of NR and BR, wherein the CB-reinforced NR is produced by wet masterbatch techniques.

7. The lifter bar of claim 5, wherein the ratio of NR:BR is within the range of from about 90:10 to about 50:50 by weight.

8. The lifter bar of claim 1, wherein the top layer has a tensile strength within the range of from about 26 to about 34 MPa.

9. The lifter bar of claim 1, wherein the top layer has a Die C tear strength within the range of from about 120 to about 170 kN/m.

10. The lifter bar of claim 1, wherein the top layer has a cut/chip % weight loss that is 8.5 or less.

11. The lifter bar of claim 1, wherein the bottom layer has a frictional abrasion resistance measured by DIN that is less than about 80 $mm^3$.

12. The lifter bar of claim 1, wherein the top layer has a thickness within the range of from about ¼to about ⅓of the height of the lifter bar.

13. An AG or SAG mill including a lifter bar according to claim 1.

14. The lifter bar of claim 1, wherein the leading face is concave.

15. The lifter bar of claim 1, wherein the lifter bar has a trailing face and wherein the leading face and the trailing face are not symmetrical with reference to a surface normal to the face of the lifter bar and intersecting the lifter bar between the leading face and the trailing face.

* * * * *